US006431471B2

(12) United States Patent
Anzinger et al.

(10) Patent No.: US 6,431,471 B2
(45) Date of Patent: Aug. 13, 2002

(54) BI-FUEL INJECTOR, IN PARTICULAR FOR COMBUSTION ENGINES, AND METHOD OF INJECTION

(75) Inventors: Claus Anzinger; Attila Bokodi, both of Munich; Eberhard Holder, Kusterdingen; Gerhard Kroetz; Wolfgang Legner, both of Munich; Viktor Pfeffer, Ostfildern, all of (DE)

(73) Assignee: DaimlerChrysler AG, Stuttgart (DE)

( * ) Notice: Subject to any disclaimer, the term of this patent is extended or adjusted under 35 U.S.C. 154(b) by 52 days.

(21) Appl. No.: 09/728,326

(22) Filed: Dec. 1, 2000

(30) Foreign Application Priority Data

Dec. 10, 1999 (DE) ..... 199 59 851

(51) Int. Cl.[7] ..... F02M 51/00
(52) U.S. Cl. ..... 239/585.1
(58) Field of Search ..... 239/5, 585.1; 137/111–113

(56) References Cited

U.S. PATENT DOCUMENTS

| | | | | |
|---|---|---|---|---|
| 4,736,712 A | | 4/1988 | Savkar et al. | 123/23 |
| 4,856,713 A | * | 8/1989 | Burnett | 239/113 |
| 5,127,426 A | * | 7/1992 | D'Archambaud | 137/113 |
| 5,450,832 A | * | 9/1995 | Graf | 123/515 |
| 5,601,067 A | * | 2/1997 | Wirbeleit et al. | 123/25 E |
| 5,887,799 A | * | 3/1999 | Smith | 123/575 |
| 5,996,558 A | * | 12/1999 | Ouellette et al. | 123/27 GE |
| 6,035,837 A | * | 3/2000 | Cohen et al. | 123/27 GE |

FOREIGN PATENT DOCUMENTS

| | | |
|---|---|---|
| DE | 2908375 | 9/1980 |
| DE | 19746489 | 4/1999 |

* cited by examiner

*Primary Examiner*—Lesley D. Morris
(74) *Attorney, Agent, or Firm*—Davidson, Davidson & Kappel, LLC

(57) ABSTRACT

A flushable bi-fuel injector, in particular for combustion engines, comprises a nozzle body incorporating a nozzle exit (11), a movably held valve needle (12) for opening and closing the nozzle exit (11), a first supply channel (13) for supplying a first liquid or a first fuel to the nozzle exit (11); and a second supply channel (23) for supplying a second liquid or a second fuel or a liquid additive to the nozzle exit (11). A ring-shaped slide gate (21) or a ring piston is arranged in a ring-shaped chamber (20) within the nozzle body (1). The slide gate (21) can be hydraulically activated to either side via differential pressure. Depending on its position, the slide gate (21) connects either the first supply channel (13) or the second supply channel (23) to the nozzle exit (11).

During operation, depending on operational requirements, either a first liquid or a first fuel or a second liquid which can be a second fuel or a starting fuel, is conveyed to a combustion chamber of an internal combustion engine, with the pressure differential between the first liquid and the second liquid causing switchover of the supply in the bi-fuel injector.

21 Claims, 2 Drawing Sheets

BI-FUEL INJECTOR, IN PARTICULAR FOR COMBUSTION ENGINES, AND METHOD OF INJECTION

BACKGROUND INFORMATION

1. Field of the Invention

The present invention relates to a bi-fuel injector, in particular for combustion engines, as well as to a method of injection.

2. Background of the Invention

In general, bi-fuel injectors are used for injecting or for supplying various liquids in devices such as, e.g., internal combustion engines, air conditioning units, a moistening apparatus or reformers in fuel cells.

In internal combustion engines or combustion engines, fuel and a liquid additive are injected into the combustion chamber of an internal combustion engine so as to reduce pollutant emission of the internal combustion engine, and if applicable, to increase its efficiency. Such a bi-fuel injector is for example disclosed in German Patent Application No. 197 46 489 A1 which describes a bi-fuel nozzle for injection of diesel fuel as well as a liquid additive, such as e.g. water, into a combustion chamber of an internal combustion engine. Several 2/2-way valves arranged outside the actual nozzle body regulate the conveyance of fuel into, and out of, a pressure chamber. When the fuel is conveyed out of the pressure chamber, liquid additive can flow into the pressure chamber via a check valve and is thus made available for injection.

For example, in order to further reduce pollutant emission of combustion engines and to comply with increasingly stringent limiting values and statutory standards, it is necessary to take into account the cold start emission of motor vehicles, including passenger motor vehicles. Furthermore, an improvement in cold-start behavior and in operation during the warm-up period is desirable.

One approach to achieving this is to divide the fuel into a component which is injected during cold starting resulting in optimal results during the warm-up period, and a fraction which is supplied when the engine is warm.

Approaches followed up to now have provided two separate injection valves in order to supply the various liquids or fuel fractions or fuels to the respective devices, for example to the combustion chamber of the engine. This is however associated with the disadvantage in that it requires considerable space and that there is insufficient space, e.g. in the intake manifold, to direct both injection valves directly to the inlet valves of the engine. In other words, the position achieved is not optimal, which in turn leads to impaired efficiency. Furthermore, this approach is very costly.

Attempts have thus been made to supply both liquids, in particular both fuels or types of fuel, via one injection valve. This is however associated with the problem that there is insufficient space in the valve itself for active switchover.

By contrast, if separation into shutoff valves is effected outside the injection valves, then large residual volumes of the liquid to be shut off prevent quick switchover, or in the case of combustion engines, prevent effective pollutant reduction in the cold-start phase. In other words, the volumes of the pipes and the injection valves up to their exit apertures may for example still contain fuel unsuitable as a starting fuel. But in the case of combustion engines, pure starting fuel should be available right from the first injection stroke, so as to achieve effective pollutant reduction in the cold-start phase.

SUMMARY OF THE INVENTION

It is an object of the present invention to create a bi-fuel injector which is particularly suitable for combustion engines and which allows quick switchover when different liquids and/or fuels are supplied. For example when applied in combustion engines or internal combustion engines, a more effective pollutant reduction particularly in the cold-start phase is to be achieved by the invention. Furthermore, a method of injection is to be disclosed which allows a quick changeover of liquid so that e.g. pollutant reduction in particular during cold start of a combustion engine can be effectively reduced. According to a further aspect, high reliability is to be ensured.

Characteristics and advantages of the present invention which have been provided in the following description of the bi-fuel injector, also may apply to the method of injection according to the present invention. Furthermore, characteristics and advantages provided in the description of the method of injection, also may apply to the bi-fuel injector according to the present invention.

The bi-fuel injector according to the present invention, which e.g. is suitable for combustion engines, comprises a nozzle body with a nozzle exit, a moveably held valve needle for opening and closing the nozzle exit, a first supply channel for supplying a first liquid to the nozzle exit, a second supply channel for supplying a second liquid or a liquid additive to the nozzle exit, as well as a slide gate which is arranged in a chamber of the nozzle body and which is hydraulically operable, and which depending on its position, either connects the first supply channel or the second supply channel to the nozzle exit.

The bi-fuel injector according to the present invention makes it possible to supply two different liquids and/or different types of fuel via a single injection valve. This results in particular in an effective reduction of pollutants, especially in the cold-start phase of a combustion engine. A quick change between liquids is possible with high reliability. During cold starting for example, pure starting fuel is available from the very first injection stroke. The volumes in the injection valve up to the exit apertures are very small. Furthermore, injection can take place in an optimal position, resulting e.g. in more effective combustion and more effective pollutant reduction. Costs are significantly reduced not only because there is no need for a second injection valve for the second liquid or for the second fuel, but also because there is no need for an expensive control system for example via additional valves. The bi-fuel injector is particularly reliable because there are no control systems or complex components susceptible to failure, or alternatively such control systems are reduced to a minimum.

Preferably, the slide gate is designed as a ring-shaped piston and the chamber in which the slide gate is located is e.g. a toroidal chamber. This saves additional space and allows economical design which is advantageous especially for series production.

Preferably the slide gate separates the first liquid from the second liquid or the first fuel from the second fuel or from the liquid additive. Mixing of the various liquids or fuels is avoided in this way, and the slide gate can e.g. be designed so as to be effective as a result of the pressure differential between the two liquids or fuels, which for example are located on opposite sides of the slide gate.

Preferably, targeted leakage or a leakage gap for the return flow of the first liquid is provided, so as to flush the bi-fuel injector during activation of the slide gate. This also results in the selected liquid being available immediately, so that for example during cold starting of an engine, a cold-start fuel is injected from the very beginning. Preferably there is an aperture or a gap to this effect between the valve needle or the valve needle head and the respective guide, with liquid or fuel, located between the slide gate and the nozzle exit, being able to flow back into the first supply channel if the second supply channel is connected.

Preferably, the slide gate can be moved between a first position and a second position, whereby in the first position the second supply channel is closed by the slide gate while the first supply channel is open; and in the second position the first supply channel is closed by the slide gate while the second supply channel is open.

For example, the chamber in which the slide gate is located is connected to the first supply channel by a first aperture, and to the second supply channel by a second aperture, with in particular, a further aperture being provided to the nozzle exit, and with the slide gate, depending on its position, closing off either the first aperture or the second aperture. In this way, a particularly effective and reliable switchover of liquid supply or fuel supply takes place in the bi-fuel injector or in the injection valve, while the design is economical.

The slide valve is e.g. slidable as a result of the pressure in the first supply channel and/or by the pressure in the second supply channel. There is thus no need for an active switchover mechanism, e.g. through electromagnetic activation. This saves space and costs. The system can for example be designed such that an increase in pressure of the second fuel or of the second liquid or of the liquid additive results in activation of the slide gate so that the first liquid or the first fuel is shut off while the second liquid or the second fuel is injected. When the pressure of the second liquid is reduced again, e.g. the pressure of the first liquid predominates, causing the slide gate to return to its home position, thus blocking supply of the second liquid. In this position of the slide gate, the first liquid or the first fuel is then injected. In other words, the slide gate can be moved by the pressure differential between the two liquids.

Preferably the slide gate comprises one or several sealing rings so that a very effective separation between the two liquids or fuel types can take place.

It is thus not possible for fuel to seep through between the slide gate and a wall of the chamber in which it is located.

It is particularly advantageous if the slide gate comprises molded-on sealing lips, as this considerably reduces the friction between the slide gate and the wall of the chamber.

Advantageously, the valve needle comprises radial apertures or drill holes for admitting the first liquid from the interior of the valve needle into the chamber containing the slide gate. During operation, the first liquid or the fuel can thus flow through the valve needle and enter the chamber of the slide gate via the radially arranged drill holes. This results in a particularly even and effective supply of liquid or fuel, with the valve needle working precisely and reliably.

Preferably, the slide gate is made of one material and/or of one component. It is advantageous if the slide gate is arranged in the front region of the valve needle, so that the volume or dead volume between the slide gate and the nozzle exit is small when compared to the supply channels, so that as a result of this e.g. only a small volume is flushed through.

In the method of injection according to the invention, depending on operational requirements, either a first liquid or a second liquid is injected or supplied to a combustion chamber of an internal combustion engine, with a slide gate being activated by a pressure differential between the first liquid and the second liquid, with said slide gate causing a switchover between, two supply channels in a bi-fuel injector. In this way, e.g. fast switchover and effective reduction of pollutants can take place, in particular during the cold-start phase of the combustion engine. By switching over the liquid or fuel supply in the bi-fuel injector itself, only small undesirable volumes are contained, so that the respective optimal liquid or optimal fuel is injected directly after switchover. The method does not require any expensive valve control systems or switchover devices outside the injector or the injection nozzle, so that as an additional advantage costs are saved, there is no requirement for a lot of space, and high reliability is achieved.

Preferably the second liquid is a liquid additive or a second fuel which is for example supplied during start-up of the combustion engine or during the warm-up period of the combustion engine. This considerably improves cold-start behavior and reduces pollutant emission which is particularly significant during engine start.

Advantageously, during switchover, a fuel or a liquid to be shut off is forced back against the direction of supply, thus resulting in a return flow. This further reduces the undesirable volume. In particular the return channel is shut off after a lead time. Furthermore, when switching between the supply of liquid or fuel and liquid additive, rinsing can take place during a lead time.

Preferably, the lead time for rinsing and/or for the return flow of liquid or fuel to be shut off is less than a second, in particular preferably less than 0.5 seconds i.e. the lead time is e.g. no longer than the time required for activating a starting device of the combustion engine. In this way it is ensured that e.g. from the time of turning an ignition key to the start position and thus from the start of a starter motor, a starting fuel is available and can be injected without any delay right from the beginning.

In the method of injection, the slide gate can be moved from a first position to a second position by pressure impingement of the liquid or the fuel and/or the liquid additive. During this action the slide gate opens up a connection between a supply channel and a nozzle exit, while closing a connection between a further supply channel and the nozzle exit.

Preferably, the liquid additive is a second fuel with a lower boiling point than that of a first fuel, with the second fuel being injected during cold start. Advantageously, the fuel is cracked on board to a low-boiling component and a high-boiling component using a reactor. In this way, the tank needs to be filled only with a single fuel, while it is nonetheless possible for injection to take place with the fuel component that is optimal for the respective operational state.

The design of the bi-fuel injector which forms a so-called bi-fuel injection valve, is such that it can be used without any modification, for example on the induction pipe engine instead of a traditional injection valve. If necessary, only the fuel system will have to be adapted.

The low-boiling fuel fraction supports ignition more readily and is therefore injected during cold start.

The principle of switchover according to the invention can thus not only be used for injectors of internal combustion engines but also for other types of switchable injectors. For example such a bi-fuel injector and the method of injection can be used in fuel cells, to inject a medium.

BRIEF DESCRIPTION OF THE DRAWINGS

The present invention is described below with respect to drawings showing some examples, as follows.

DETAILED DESCRIPTION

Figure 1:
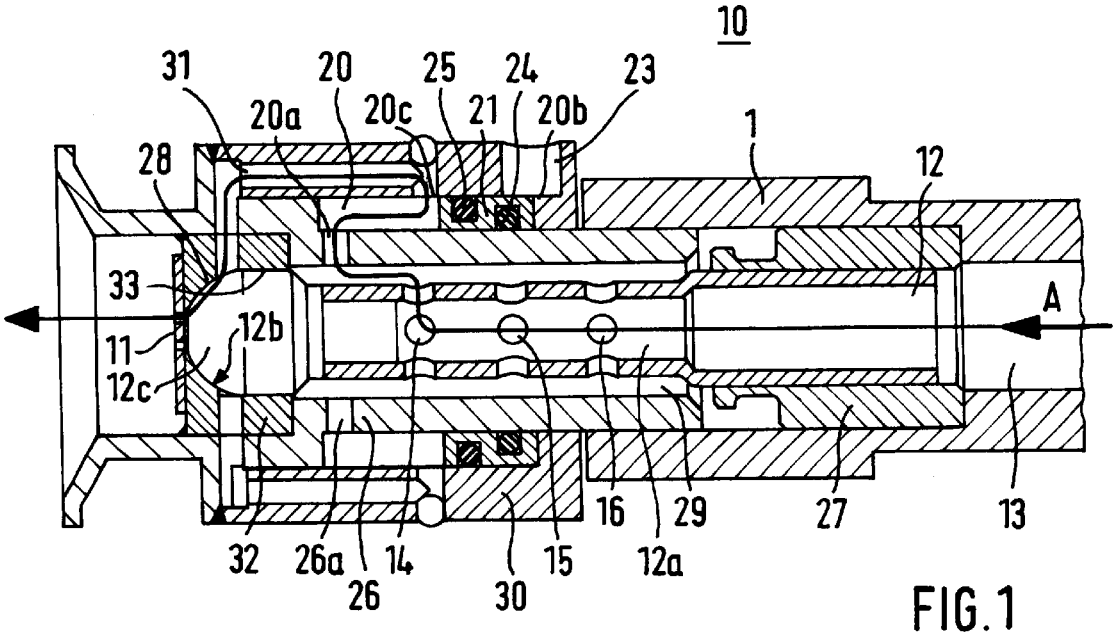
FIG. 1 shows a longitudinal section of a bi-fuel injector according to the invention, as a preferred embodiment of the invention, in an operational state where a first fuel is supplied as a first liquid.

FIG. 1 is a diagrammatic representation of a sectional view of a preferred embodiment of the bi-fuel injector according to the invention. The bi-fuel injector 10 comprises a nozzle body 1 at whose front end a nozzle exit 11 is arranged. During operation, fuel is injected through the nozzle exit 11 into a combustion chamber of an internal combustion engine or a combustion engine. The nozzle body 1 comprises a valve needle 12 which is movably held. By moving the valve needle 12 to and fro in the interior of the nozzle body 1, the nozzle exit 11 can be opened and closed to carry out an injection process. The interior of the nozzle body 1 contains a partial area of a first supply channel 13 which is used to supply a first fuel to the nozzle exit 11. The supply of the first fuel is indicated by arrow A.

The valve needle 12 comprises an interior space 12*a* which forms part of the supply channel 13 through which the first fuel is channeled during operation. In the frontal region of the valve needle 12 there are radially arranged drill holes 14, 15, 16 through which the first fuel can issue from the interior space 12*a* of the valve needle 12 and subsequently reach the nozzle exit 11. A chamber 20 is arranged in the nozzle body 1 such that fuel flows through it during supply of the first fuel to the nozzle exit 11. The chamber 20 comprises a slide gate 21 which is movably held in the chamber 20 or which can be moved to and fro in a longitudinal direction of the bi-fuel injectors.

A further supply channel 23 is used to supply a second fuel or a liquid additive to the nozzle exit 11. The second supply channel 23 also opens to the chamber 20 so that at a corresponding position of the slide gate 21, the second fuel is conveyed through the chamber 20 to the nozzle exit 11. This operational state is shown in FIG. 2 where the slide gate 21 is at the front end of the chamber 20 so that the second fuel is conveyed to the nozzle exit 11 in the direction of arrow B through the second supply channel 23 via the chamber 20.

The slide gate 21 is hydraulically operated, i.e. it is moved to and fro by pressure differential between the first supply channel 13 and the second supply channel 23. Thus, depending on the position of the slide gate 21, either the first supply channel 13 or the second supply channel 23 is connected to the nozzle exit 11.

In the embodiment shown, the slide gate 21 is a slide ring or a ring-shaped piston. The chamber 20 is also ring-shaped, i.e. it forms a toroidal chamber enclosing the valve needle 12 and the first supply channel 13. At the front end of the toroidal chamber 20 there is an aperture 20*a* to the first supply channel 13. At the opposite end of the chamber 20 there is an aperture 20*b* to the second supply channel 23. Between the apertures 20*a*, 20*b*, i.e. in the middle of the toroidal chamber 20, there is a further aperture 20*c* which connects the chamber 20 with the nozzle exit 11.

Figure 2:
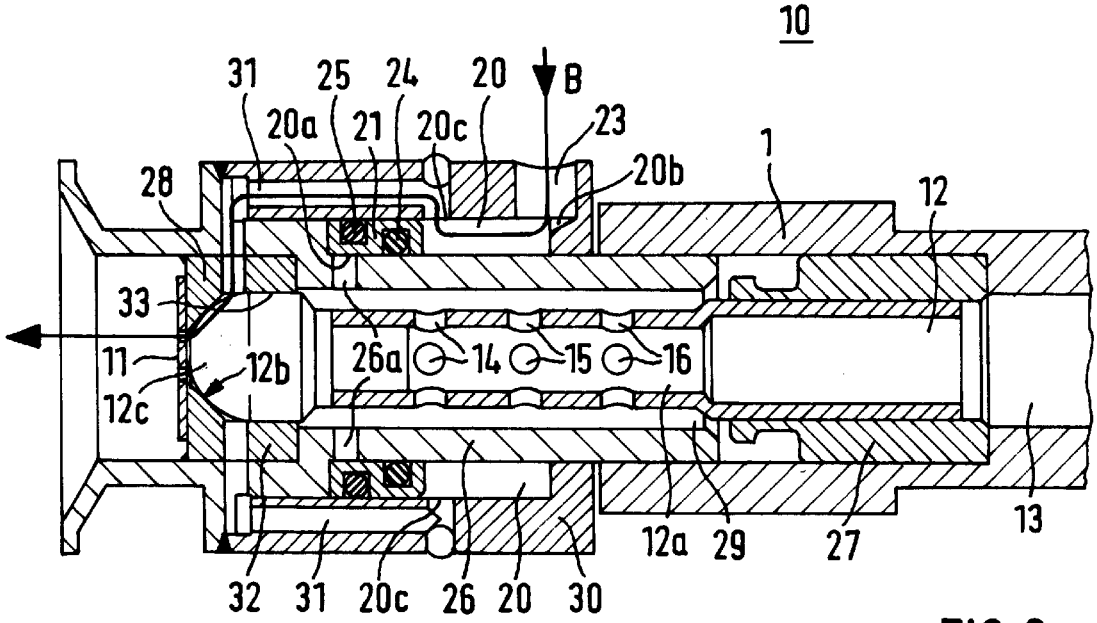
FIG. 2 shows a further longitudinal section of the bi-fuel injector shown in FIG. 1, except that it shows a different operational state where a second fuel is supplied as a second liquid.
Figure 3:
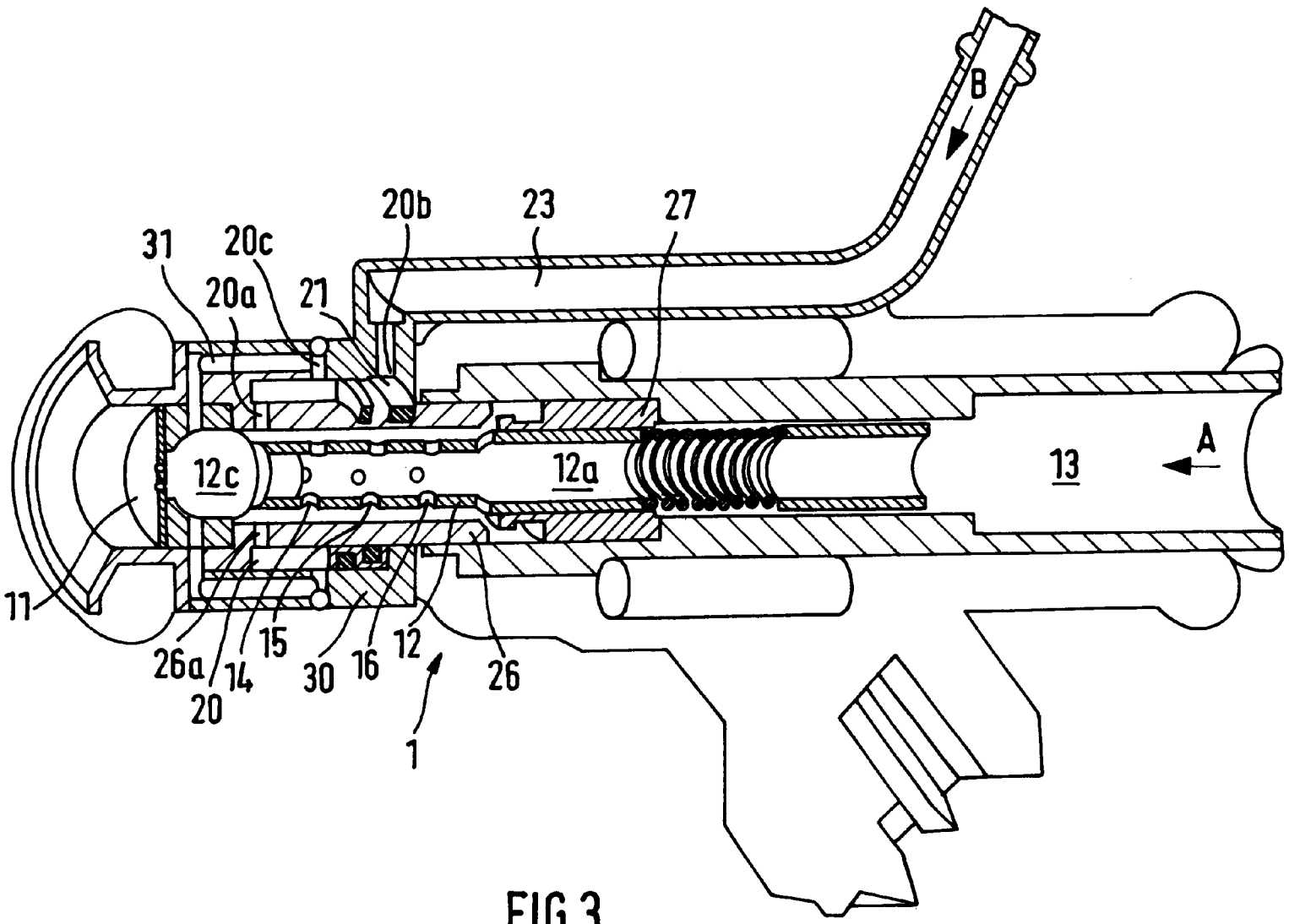
FIG. 3 is a diagrammatic and partial perspective section of the bi-fuel injector according to the present invention, in the operational state as shown in FIG. 1.

The apertures 20*a*, 20*b* are designed such that pressure forces in the respective supply channel 13, 23 in FIGS. 1 to 3 impinge laterally on the slide gate 21 so as to move said slide gate 21 in the chamber 20, depending on the pressure differential in the supply channels. The slide gate 21 separates the first fuel which is located in the first supply channel 13, from the second fuel which is located in the second supply channel 23. So as to establish the best possible seal to the inner and outer wall of the chamber 20, the slide gate 21 comprises an inner sealing ring 24 and an outer sealing ring 25. In an alternate embodiment, the slide gate may comprise molded-on sealing lips as a result of which friction is still further reduced.

An inner wall 26 which is also ring shaped, separates a cylindrical space 29 in which the valve needle 12 is arranged, from the ring-shaped chamber 20 in which the slide gate 21 is arranged. The wall 26 forms a guide for the ring piston or slide gate 21.

In the region of the second supply channel 23 a ring-shaped cap 30 encloses the chamber 20. The cap 30 comprises the second supply channel 23, with cap 30 also constituting part of the nozzle body 1.

The rear end of the valve needle 12 is enclosed by an armature 27. The front end of the valve needle 12 is beveled or tapered; it rests against a valve seat 28 arranged at the front end of the nozzle body 1. When the valve needle 12 is open, a gap or clearance forms between the valve seat 28 and the tip 12*c* of the valve needle, with fuel or liquid from the interior of the bi-fuel injector 10 being able to issue through the nozzle exit 11 via said gap or clearance. The nozzle exit 11 comprises a multitude of through-holes through which fuel can issue. In the preferred embodiment, the nozzle exit 11 is configured as an apertured diaphragm, with the through-holes being arranged in a special pattern so as to achieve an optimal spray pattern, or optimal distribution of the ejected fuel.

The drill holes 14, 15, 16 in the frontal region of the valve needle 12 extend radially outward, thus establishing a connection between the interior space 12*a* of the valve needle and the space 29 enclosing the valve needle 12. In each instance 4 drill holes 14, 15, 16 are arranged as through-holes, so that during supply from the interior space 12*a* of the valve needle, the first fuel can evenly be conveyed to space 29 in various radial directions.

The inner wall 26 comprises through-holes which form the connection to aperture 20*a* in chamber 20 and which radially extend through the inner wall 26. But it is equally possible, instead of holes, to provide a gap or annular gap extending ring-shaped around space 29, thus establishing the connection to the chamber 20.

A channel 31 through which the fuel or the liquid from chamber 20 is conveyed to the nozzle exit 11 connects to the middle aperture 20*c* of chamber 20. Channel 31 can for example be a gap or an annular gap extending in the housing of nozzle body 1 or contained in cap 30.

FIG. 3 shows a diagrammatic sectional view of the bi-fuel injector with partial perspective view. FIG. 3 further illustrates the design of the bi-fuel injector according to the present invention shown in FIGS. 1 and 2. Here the slide gate 21 is in its first position, i.e. at the right end of chamber 20 in the diagram shown. In this position the second supply channel 23 is closed so that no fuel can flow from the second supply channel 23 into the chamber 20 of the slide gate 21. In other words, the slide gate 21 is blocking aperture 20*b* of chamber 20.

As shown in FIG. 1, in this first position of the slide gate 21, the opposite aperture 20*a* of chamber 20 is opened so that the first fuel from the first supply channel 13 can flow through the interior space 12*a* of the valve needle 12 into chamber 20. At the same time, the middle aperture 20*c* of chamber 20 is open so that the first fuel can flow onward from chamber 20 via channel 31 to the nozzle exit 11.

The slide gate 21 extends in longitudinal direction of the bi-fuel injector at a length shorter than or equal to the distance between the middle aperture 20*c* and the front aperture 20*a* or the rear aperture 20*b*. Thus, depending on the respective position of slide gate 21, one of the apertures 20*a*, 20*b* is closed while the middle aperture 20*c* is open, allowing a through-flow through chamber 20. During an injection pulse, the tip 12*c* of the valve needle 12 moves away from the valve seat 28 so that the nozzle exit 11 opens and the fuel is injected from the first supply channel into the combustion chamber of the internal combustion engine at the pressure prevailing in said first supply channel.

The front part of the valve needle 12 is movably held in a guide 32. Between this part of the valve needle 12 and the cylindrical guide 32 there is a small gap 33 or clearance through which fuel contained in channel 31 can be forced back to space 29 of the valve needle by pressure impingement. In this way, flushing can be achieved during switchover of the slide gate 21.

Below, the method of injection is described in detail with reference to FIGS. 1 and 2.

FIG. 1 shows the bi-fuel injector in normal operation. The fuel pressure is present at the rear rail connection, i.e. the first fuel or normal fuel is under pressure in the first supply channel 13, such pressure for example being generated by a common-rail compressed air system. In FIG. 1 the slide gate 21 is in the right-hand position, i.e. in a first position in which it tightly closes off the lateral supply channel 23. In the supply channel 23 there is a second fuel which is used as a starting fuel and which is to be injected during an engine start or during a cold start. The tight closure of the lateral starting fuel connection shown in the diagram prevents any mixing of the two types of fuel.

The normal fuel or first fuel in the first supply channel 13 flows through the valve needle 12 in flow direction A and by way of drill holes 14, 15, 16 reaches the space 29 which in the region of the drill holes 14, 15, 16 surrounds the valve needle 12. From there, the first fuel in front of the front guide or inner wall 26 enters the chamber 20 of the slide gate 21 via four radially arranged drill holes 26*a*, said chamber 20 being a toroidal chamber. From there, the first fuel reaches the front, via further radial and axial drill holes or channels 31 in the cap 30, before finally reaching the valve seat 28 between a sealing surface 12*b* of the valve needle 12 and its guide.

An electromagnetic drive activates the valve needle 12 thus opening the nozzle exit 11. During activation, the valve needle point 12*c* moves to the rear, i.e. to the right in the diagram, so that the valve needle point 12*c* moves away from the valve seat 28 and fuel from the first supply channel 13 issues from the bi-fuel injector, thus for example being conveyed to an induction pipe of a combustion engine or to a combustion chamber.

If a cold start is necessary, the system pressure of the second fuel, which is a fuel especially suited to the starting process, is applied at the second supply channel 23 or at the lateral starting fuel connection. As soon as the pressure of the fuel in the second supply channel 23 is greater than the pressure of the fuel in the first supply channel 13, the slide gate 21 is moved to the second position, shown in FIG. 2, as a result of the effective pressure forces. During this, a return-flow option is opened at the rail connection or normal connection. When the slide gate 21 is moved from the first position (see FIG. 1) to the second position (see FIG. 2), said slide gate forces back the normal fuel or first fuel present in the toroidal chamber 20.

When the slide gate 21 has reached the extreme left position in the FIG. 2 it closes off aperture 20*a* so that normal fuel from the first supply channel 13 can no longer reach the chamber 20. At the same time aperture 20*b* of the chamber 20 is opened so that the starting fuel or the second fuel contained in the second supply channel 23, can flow through the radial drill holes or apertures 20*b*, 20*c* into cap 30 and the channels 31 contained therein. From there the starting fuel reaches the valve seat 28.

Due to the gap 33 described above, the first fuel which is still contained in channel 31 is forced back into the space 29 while the nozzle exit 11 is still closed. Thus a flushing action takes place before the starting fuel is injected.

As long as the return channel remains open, there is a pressure differential at the valve needle seat, as a result of which the normal fuel or first fuel is pushed back against the direction of supply A, through the aperture 20*a* or the gap 33 and the drill holes 14, 15, 16. Since the gap 33 is directly in front of the nozzle exit 11, the entire dead volume can be displaced so that it is precluded from being injected. In other words, the starting fuel which is supplied via the second supply channel 23 can be injected already at the first injection stroke. This is particularly the case if there is adequate lead time for flushing to take place.

The change of position of the slide gate 21 and the flush time determined by the flush rate must be considered when calculating the lead time. While the movement of the slide gate 21 is somewhat decelerated as a result of the friction between the sealing rings 24, 25 and the walls of the chamber 20, this is not associated with any significant problems. If the slide gate 21 comprises molded-on sealing lips, friction is reduced to a large extent. The flush rate again depends on the dimensions of the gap 33 and the fitting length of the guide. These dimensions have been selected to achieve an adequate flush rate which allows fast switchover between the fuel types supplied.

After the lead time, the return channel is shut off so that the pressure difference is equalized and thus no forces act on the valve needle 12. This takes into account that the supply of starting fuel or second fuel is limited; thus the loss through flushing should not be overlooked.

The gap or gaps 33 are dimensioned such that the lead time does not exceed the time between the turning of an ignition key to the start position and the start-up of a starter motor. Thus the lead time may be in the range of a few seconds, it may be less than a second or even less than half a second. In this way, starting fuel can be injected without any delay, right from the beginning, without the need for additional time during the start-up process.

During injection of the starting fuel, said starting fuel is conveyed in the direction of arrow B in FIG. 2, through the second supply channel 23 to chamber 20 from where it reaches the valve seat 28 via one or several channels 31. During an injection pulse, the valve needle point 12*c* moves to the right in the figure so that said valve needle point 12*c* lifts away or moves away from the valve seat 28, so that fuel from the nozzle exit 11 is injected into the combustion chamber of the internal combustion engine or into an induction pipe.

As soon as the start phase or the cold-start phase has been completed, a switchover of fuel supply takes place in the bi-fuel injector 10. This is effected by a reduction in pressure in the second supply channel 23. In this way, a differential pressure is created on both sides of the slide gate 21, said differential pressure moving said slide gate 21 to the right in FIG. 2, so that said slide gate 21 again assumes its first position or home position (see FIG. 1). In this position, the way is clear for the supply of normal fuel or of fuel for the normal operating condition, said normal fuel being supplied via the first supply channel 13. At the same time, the supply of starting fuel which is contained in the second supply channel 23 is terminated.

The vehicle comprises an on-board reactor which splits the fuel into a low-boiling component and a high-boiling component. The low-boiling component of the fuel ignites more easily and is therefore injected during cold start. However, it is also possible to carry two different fuels which are supplied to the bi-fuel injector via respective storage containers or tanks.

The bi-fuel injector 10 or the method of injection described herein are not limited to the supply of two different fuels or to operation during the start or warm-up period of the combustion engine. Generally it is possible to inject a fuel such as e.g. petrol or diesel and a liquid additive such as e.g. a second fuel or water, and to switch over during operation.

The bi-fuel injector shown here constitutes a bi-fuel injection valve with an integrated separation within the valve and an active switchover device outside the valve. External switchover is via electromagnetic shutoff valves. A sealing piston separates the two liquids directly in the bi-fuel injection valve. The piston is a ring-shaped sliding piston which is moved as a result of the system pressure and thus does not require activation of its own. The bi-fuel injector can be flushed by targeted leakage between the valve needle and the valve needle seat. Generally, the principle of switchover is also applicable to other types of switchable injectors.

"Channel" as defined herein can be any type of conduit. "Valve needle" as defined herein can be any type of valve closure device.

Reference List

1 Nozzle body
10 Bi-fuel injector
11 Nozzle exit
12 Valve needle
12*a* Interior space of the valve needle
12*b* Sealing surface
12*c* Valve needle point
13 First supply channel
14 Drill hole
15 Drill hole
16 Drill hole
20 Chamber
20*a* Aperture in the chamber
20*b* Aperture in the chamber
20*c* Aperture in the chamber
21 Slide gate
23 Second supply channel
24 Interior seal
25 Exterior seal
26 Inner wall (guide)
26*a* Drill hole
27 Armature
28 Valve seat
29 Space
30 Cap
31 Channel
32 Guide
33 Gap

What is claimed is:

1. A bi-fuel injector, in particular for combustion engines, comprising:

a nozzle body having a nozzle exit and a chamber;

a movable valve needle for opening and closing the nozzle exit;

a first supply channel for supplying a first liquid to the nozzle exit;

a second supply channel for supplying a second liquid to the nozzle exit; and a slide gate arranged in the chamber, the slide gate capable of being activated hydraulically, the slide gate connecting either the first supply channel or the second supply channel to the nozzle exit as a function of a position of the slide gate.

2. The bi-fuel injector according to claim 1 wherein the slide gate is a ring-shaped piston and that the chamber is a toroidal chamber.

3. The bi-fuel injector according to claim 1 wherein the slide gate separates the first liquid from the second liquid.

4. The bi-fuel injector according to claim 1 wherein the injector includes an aperture or a gap for the return flow of the first liquid, so as permit flushing of the injector during or after activation of the slide gate.

5. The bi-fuel injector according to claim 1 wherein the slide gate is movable between a first position and a second position, in the first position the second supply channel being closed by the slide gate while the first supply channel is open and in the second position the first supply channel being closed by the slide gate while the second supply channel is open.

6. The bi-fuel injector as recited in claim 1 wherein the chamber is connected to the first supply channel by a first aperture, and to the second supply channel by a second aperture, with a further aperture being provided to the nozzle exit, and with the slide gate, depending on the position, closing off either the first aperture or the second aperture.

7. The bi-fuel injector as recited in claim 1 wherein the slide gate is slidable as a function of at least one of a pressure in the first supply channel and a pressure in the second supply channel.

8. The bi-fuel injector according to claim 1 wherein the slide gate includes at least one sealing ring.

9. The bi-fuel injector according to claim 1 wherein the slide gate includes molded-on sealing lips.

10. The bi-fuel injector according to claim 1 wherein the valve needle includes radial apertures or drill holes for admitting the first liquid from an interior of the valve needle into the chamber.

11. The bi-fuel injector according to claim 1 wherein the slide gate is made of one material or of one component.

12. The bi-fuel injector according to claim 1 wherein the slide gate is arranged in a front area of the valve needle.

13. A method of injection, in which either a first liquid or a second liquid is injected as a function of operational characteristics, comprising:

activating a slide gate through a pressure differential between the first liquid and the second liquid, the slide gate causing a switchover between two supply channels in a bi-fuel injector.

14. The method of injection according to claim 13 wherein the first liquid is a fuel and the second liquid is a liquid additive or a second fuel which is supplied when starting a combustion engine or during a warm-up period.

15. The method of injection according to claim 13 wherein during the switchover of the slide gate a liquid to be shut off is forced back against the direction of supply, thus causing a return flow.

16. The method of injection according to claim 15 wherein the return flow is shut off after a lead time.

17. The method of injection according to claim 13 further comprising flushing the flushing injector during a lead time at the switchover between the supply of the first liquid and supply of the second liquid.

18. The method of injection according to claim 13 further comprising providing a lead time for flushing or for the return flow of liquid to be shut off, the lead time being less than the greater of 1 second and a time required to activate a starting device of a combustion engine.

19. The method of injection according to claim 13 wherein the slide gate is moved from a first position to a second position by pressure of at least one of the first liquid and the second liquid, thereby opening a connection between a supply channel and a nozzle exit while closing a connection between a further supply channel and the nozzle exit.

20. The method of injection according to claim 13 wherein the second liquid is a second fuel with a lower boiling point than that of the first liquid, with the second fuel being injected during cold start.

21. The method of injection according to claim 13 further comprising cracking fuel on board into a low-boiling component and a high-boiling component using a reactor.

* * * * *